United States Patent [19]

Storandt et al.

[11] 4,394,032

[45] Jul. 19, 1983

[54] SKI SAFETY BINDING

[75] Inventors: Ralf Storandt, Leonberg; Manfred Richert, Farchant; Georg Scheck, Leonberg, all of Fed. Rep. of Germany

[73] Assignee: Geze GmbH, Leonberg, Fed. Rep. of Germany

[21] Appl. No.: 210,615

[22] Filed: Nov. 26, 1980

[30] Foreign Application Priority Data

Nov. 30, 1979 [DE] Fed. Rep. of Germany ..... 2948275

[51] Int. Cl.[3] ..... A63C 9/081

[52] U.S. Cl. ..... 280/618; 280/611; 280/624; 280/636

[58] Field of Search ..... 280/618, 613, 612, 611, 280/620, 636, 628, 616, 634

[56] References Cited

U.S. PATENT DOCUMENTS

| | | | |
|---|---|---|---|
| 3,893,684 | 7/1975 | Schweizer | 280/634 |
| 3,950,003 | 4/1976 | Korger | 280/618 |
| 3,963,253 | 6/1976 | Rieger | 280/616 |
| 4,130,297 | 12/1978 | Horn | 280/618 |
| 4,141,571 | 2/1979 | Beyl | 280/636 |
| 4,294,461 | 10/1981 | Eckart | 280/618 |

FOREIGN PATENT DOCUMENTS

| | | | |
|---|---|---|---|
| 2519544 | 11/1975 | Fed. Rep. of Germany | 280/612 |
| 2849359 | 6/1979 | Fed. Rep. of Germany | 280/618 |

*Primary Examiner*—David M. Mitchell

[57] ABSTRACT

A ski safety binding is designed to allow both a dangerous bending moment exerted about a transverse axis 15 through the weakest point of a skier's leg and a torsional moment exerted about a vertical axis 24 through the skier's leg to be detected and to be used to initiate release of the ski boot 54 from the binding when the bending and/or torsional loads approach dangerous levels. The binding basically consists of a sole plate 11 which carries a boot retaining system 56, 57 and which is mounted on a ski 12 for limited displacement in the longitudinal direction of the ski and for limited pivotal movements about a transverse axis 17 and a vertical axis 24. The sole plate is guided at its rear end for limited movement along an inclined guide 18 and along a transverse guide 21. This movement is resisted by respective hydraulic retaining means 28, 28'; 29, 29' which are however able to resiliently deflect once a predetermined load is exceeded. Movement of the sole plate in the direction of the guides 21, 28 trips a release lever 19 which releases the boot securing system. A mechanical retaining system is also described.

24 Claims, 13 Drawing Figures

Figure 1:
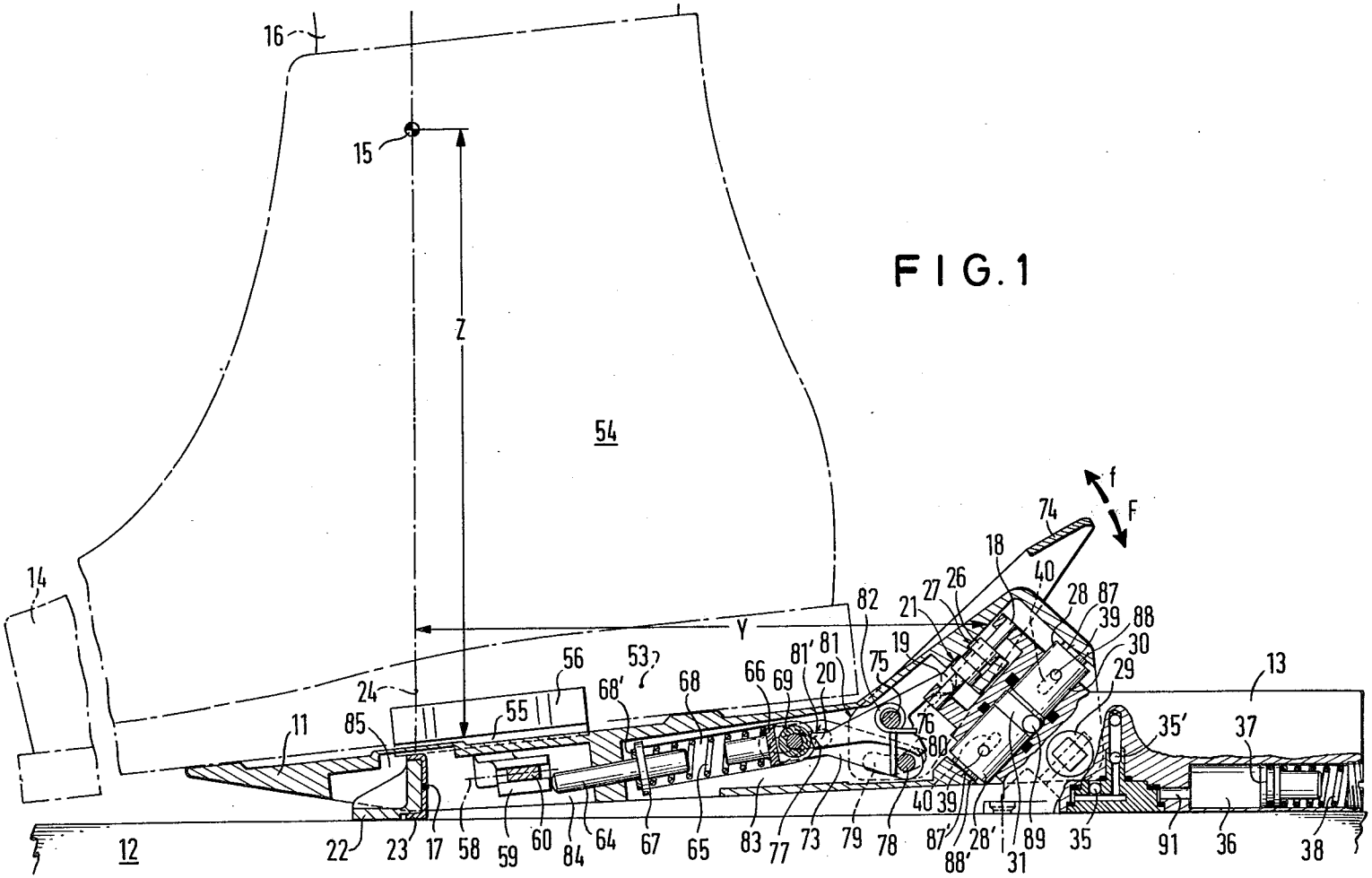

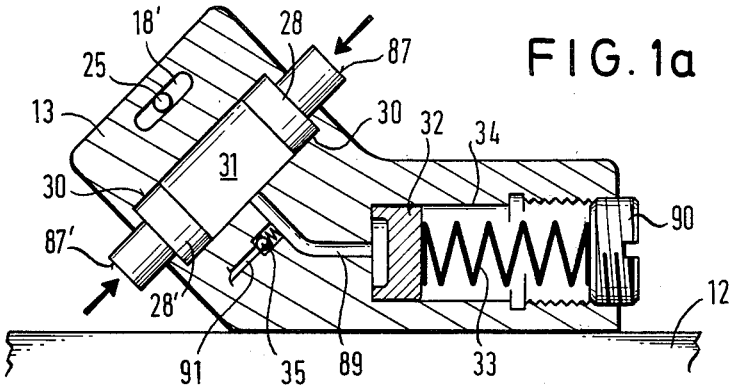
FIG. 1a
FIG. 7
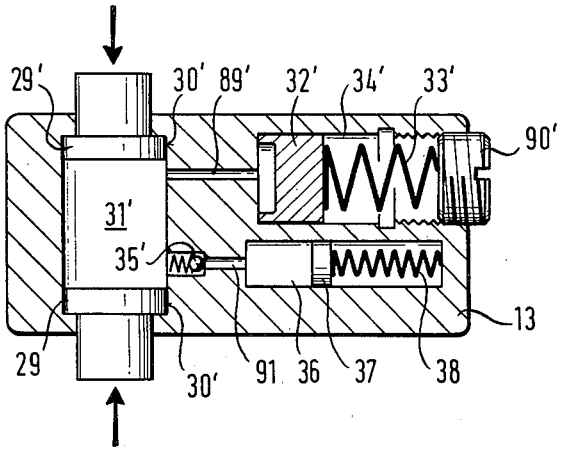
FIG. 8
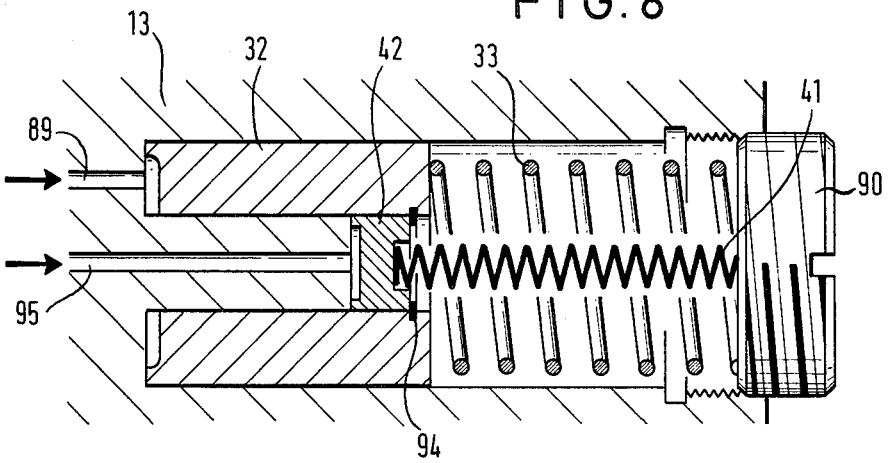

SKI SAFETY BINDING

The invention relates to a safety ski binding of the type having a sole plate carrying a ski boot securing system which is movable between closed and open positions.

In a system of this kind the sole plate is attached to the ski about at least one transverse axis and is capable of executing small pivotal movements against the force of a holding spring adapted to retain the sole plate in its normal position. A measuring system, which is arranged between the sole plate and the ski and which operates in parallel to the force of the holding spring, has a release device which travels along a release path at a predetermined pivot angle of the sole plate to release the ski boot securing system.

A known ski binding of this type (DE-OS No. 23 24 078, DE-OS No. 24 01 729) is equipped with two plates which are movable to one another. One of the two plates is fixed to the ski while the other is constructed as a sole plate which carries the ski boot securing system and is pivotable about at least one transverse axis lying between the plates. As the release signal is formed in dependence on the torque about the transverse axis lying between the plates it does not fully correspond in the desired manner to the dangerous bending moment which can be applied to the skier's leg. The point at which the bending moment operating on the skier's leg should be measured namely lies in the region of the edge of the shaft of the ski boot at a small distance inside the boot. In the longitudinal direction of the ski this point is located between the ball and heel of the ski boot and indeed preferably approximately in the middle between the ball and heel regions. In the vertical direction the position of the point at which the bending moment operating on the skier's leg and acting about a transverse axis should be measured can also be located significantly above the upper edge of the shaft of the ski boot. In general the preferred position of the measurement axis can generally be regarded as lying somewhat above the ankle.

The principal object underlying the present invention is to provide a ski safety binding of the initially named kind which releases when a predetermined bending moment is reached about a transverse axis through the endangered point of the skier's leg, namely that point which is most liable to break, without having to carry out a measurement at the position of the transverse axis itself.

To accomplish this object the invention envisages an arrangement in which:

(a) the sole plate is not only pivotable about the transverse axis between the toe part of the ski boot and the region beneath the endangered section of the skier's leg but is also supported on the ski for limited displacements in the longitudinal direction thereof, while being fixed however in a direction perpendicular to the ski;

(b) there is provided, in the longitudinal direction of the ski at a horizontal distance from the endangered section and between the sole plate and the ski, or a bearing block mounted on the ski, an inclined guide disposed in a vertical longitudinal plane and rising from the ski in a direction away from the ski boot, with the inclined guide combining the forces acting at the level of the inclined guide in a vertical direction at right angles to the ski and in the longitudinal direction of the ski to form a release force acting in the direction of the inclined guide and, (c) the release device of the measuring system responds to a predetermined displacement of the sole plate relative to the inclined guide.

In accordance with the invention the plate, in addition to its resilient freedom of movement about the transverse axis is thus also provided with a degree of resilient freedom of movement in the longitudinal direction of the ski. As a result, during a safety release, not only is account taken of the release provoking force operating in the vertical direction but also of the moment resulting from the force acting on the plate in the longitudinal direction of the ski.

The dependence of the release solely from the bending moment about the endangered section of the skier's leg is further promoted if the sole plate is supported beneath the endangered section of the skier's leg for limited pivotal movement about the transverse axis and for limited displacement in the longitudinal direction of the ski.

An optimum solution is achieved if the cotangent of the angle of the inclined guide relative to the longitudinal direction of the ski is substantially equal to the ratio of the distance of the endangered section from the sole plate to the horizontal distance of the endangered section from the inclined guide.

The invention can also be used to advantage with a ski binding in which the sole plate is also capable of restricted pivotal movement about a vertical axis which at least approximately intersects the transverse axis, against a holding spring adapted to retain the sole plate in its normal position, and in which the measuring system also responds to pivotal movement of the sole plate about the vertical axis. In this case the invention envisages that a transverse guide is also present in the vicinity of the inclined guide. Thus the torsional forces which can endanger the skier's leg can also be taken into account and lead to a release of the binding in the simplest possible manner.

One simple practical way of realizing the support of the sole plate required by the invention is to provide, in the region of the boot and between the sole plate and a support mounted on the ski, a leaf spring extending transversely to the longitudinal direction of the ski with its surface substantially perpendicular to the top surface of the ski. The leaf spring can extend on the underside of the sole plate from both sides of the sole plate to the support block which is mounted on the ski centrally therebetween. In principle however, any mounting or support member which provides the required degree of freedom can be used such as, for example, slide elements or other elastic elements such as rubber cushions.

In accordance with a first simple embodiment the inclined guide can consist of an elongate aperture or slot in which a guide pin slides. An embodiment in which the inclined guide is formed by guide bars arranged at an appropriate inclination and mounted on the ski with slide members mounted on the sole plate being arranged on the guide bars is, however, particularly advantageous. In this embodiment the transverse guide can be realized in a simple manner if the slide members are rollers which lie in roller tracks of the sole plate which extend transversely to the longitudinal direction of the ski and in which they can move transversely to the longitudinal direction of the ski but not, however, in the axial direction of the guide bars.

it is not necessary to transmit spring forces to the sole plate in the region at which the sole plate is supported. The embodiment using a leaf spring does not thus result in the creation of substantial resetting forces on the sole plate but instead merely supports the sole plate in such a manner that it can execute limited pivotal movements about transverse and vertical axes and limited displacement in both longitudinal directions. Relatively high resetting forces can however be present so long as they are constant because they can be taken into account when designing the binding.

In order to produce resilient forces which hold the sole plate in its normal position a preferred embodiment of the invention envisages that retaining members which can deflect resiliently above a predetermined force in a direction parallel to the inclined guide and, if provided, also parallel to the transverse guide, are provided between the sole plate and a support block mounted on the ski. The retaining members thus normally retain the sole plate in its normal position. The retaining members are only able to deflect against the spring force when the forces which occur in one of the two opposite direction of the inclined guide or, if provided, of the transverse guide which exceed the predetermined release value(s). In other words the retaining members hold the sole plate in its normal operating position without displacement until the release values are reached.

In an advantageous embodiment, which works on hydraulic principles, the retaining members are hydraulic retaining pistons arranged in the support block with the pistons being loaded by an incompressible pressure fluid which can resiliently escape when the release force is reached.

For this purpose two retaining pistons should be arranged opposite to one another parallel to the inclined guide in a common cylinder and should bear with their end faces which are remote from each other on the sole plate, with the movement of the pistons in the direction towards the sole plate being limited by abutments and with the facing end faces of the pistons bounding a hydraulic chamber which is hydraulically connected to a spring loaded release piston arranged in a cylinder. An incompressible pressure fluid such as oil must be used.

In order to compensate for any losses of pressure fluid in the hydraulic chamber the hydraulic chamber is connected, in accordance with an advantageous embodiment of the invention, via a non-return valve with a pressure fluid storage chamber in which, however, only a low pressure prevails.

If a torsional release is to be provided the invention envisages that two retaining pistons can also be arranged opposite to one another in a common cylinder parallel to the transverse guide and can bear at their end faces which are remote from one another on the sole plate, with the movement of the retaining pistons in the direction towards the sole plate being limited by abutments and with the facing end faces of the retaining pistons bounding a hydraulic chamber which is hydraulically connected to a spring loaded release piston arranged in a cylinder.

The further hydraulic chamber is usefully also connected with the same storage chamber via a further non-return valve in order to compensate automatically for pressure fluid losses.

In order to match the binding to the breakage characteristics of the skier's leg, in the event that superimposed beinding and torsional moments are present, a further embodiment is constructed in such a way that the load on the retaining piston for the bending release is relieved as the pressure in the hydraulic chamber for the torsional release increases. This can take place in practice by providing an auxiliary piston in the release piston associated bending release, with the auxiliary piston, which is loaded by its own spring and which bears on the release piston, being subjected to the pressure in the hydraulic chamber associated with torsional release of the binding.

In surprising manner it is satisfactory if an auxiliary piston is only arranged in one of the two retaining pistons in the described manner in order to achieve both a reduction of the moment required to affect torsional release on the presence of a specific bending moment and a reduction of the moment required to produce bending release on the presence of a specific torsional moment. The auxiliary piston is however preferably arranged in the retaining piston for the bending release in order for the retaining piston for the torsional release to be subjected to as little friction as possible so that this piston is returned as quickly and completely as possible to its initial position following a release.

A mechanically operating embodiment is characterized in that the retaining members are pivoted levers arranged on the support block and resiliently biased towards their normal position.

A particularly preferred practical embodiment is characterized in that two pivoted levers are pivotable in opposite directions against the spring force parallel to the inclined guide. In order also to allow deflection during a torsional release a further embodiment is constructed so that both pivoted levers bear via rollers on opposite sides of a rail mounted on the sole plate and extending parallel to the transverse guide.

Both pivoted levers can be acted on by a single spring by using an arrangement in which the pivoted levers are connected via a further arm to a pull rod which is loaded by the spring.

A mechanical torsional release can additionally be ensured by an arrangement in which two pivoted levers which are preferably united into one component are pivotable in opposite directions against spring force parallel to the transverse guide. In this case, in order to get away with only a single release spring, the invention further envisages an arrangement in which the component is connected to a pull rod loaded by a spring and is drawn by this pull rod against edge pivots. The mechanical embodiment of the invention is also intended to allow the leg breakage hypothesis to be taken into account when bending and torsional moments are superimposed on each other. This can take place, in accordance with a preferred embodiment by relieving the load on the pivoted levers associated with torsional release as the bending moment increases. In practice this can, for example, take place by using an arrangement in which a second spring is provided on the first pull rod and normally presses a spring plate against an abutment on the pull rod. After an infinitesimal travel of the bending release system the plate is arranged to press against a pivoted link which relieves the load on the pivoted levers associated with torsional release up to a predetermined fraction of this load as the bending moment increases.

As a result of this construction the two springs jointly form the release spring for the bending load. One of the springs is however neutralized as long as the spring plate remains in contact with the abutment on the pull rod beneath a specific fraction of the maximum bending moment. If the bending moment goes above this fraction, for example 75%, then the spring plate contacts the link and increasingly relieves the release setting of the torsional release mechanism until a value of say 75% is reached at the maximum bending moment.

In this embodiment the second spring is also consciously embodied in the bending release mechanism so that the binding is rapidly reset to its initial position without hinderance from avoidable friction forces following a torsional release.

Figure 2:
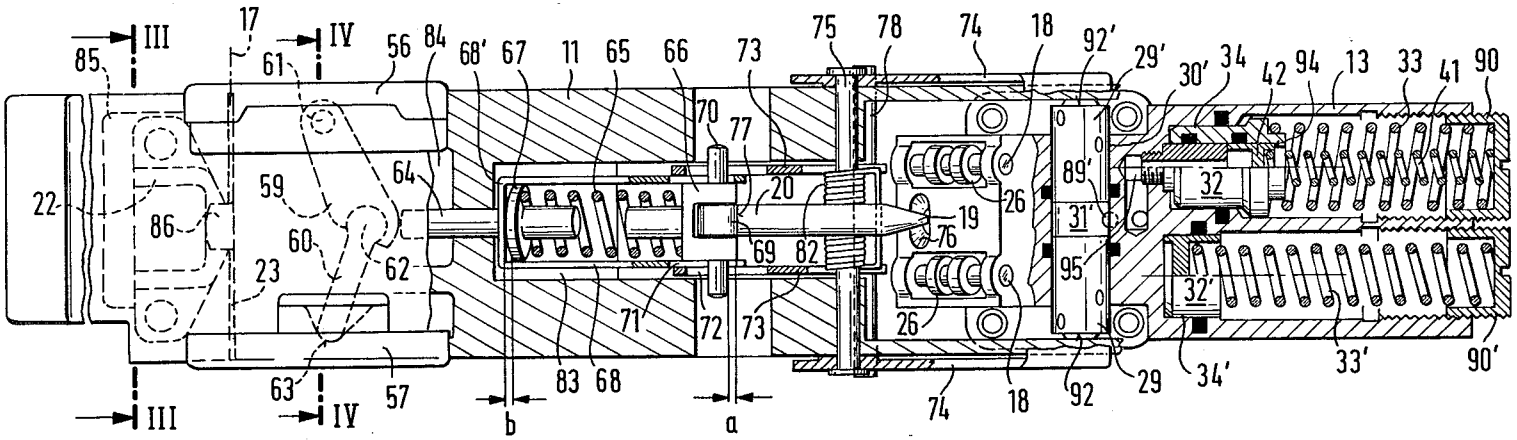
Figure 4:
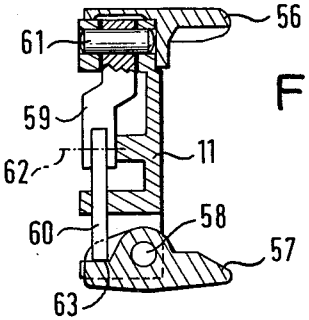
Figure 3:
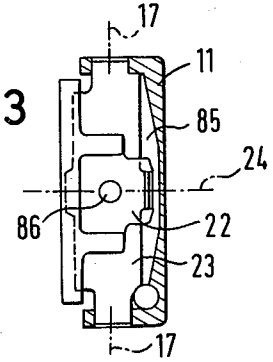
Figure 5:
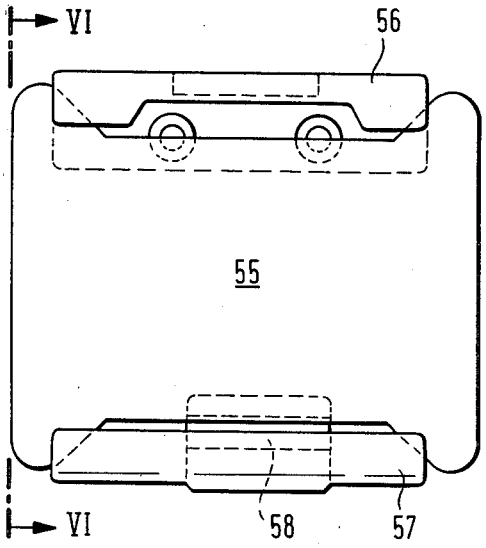
Figure 6:
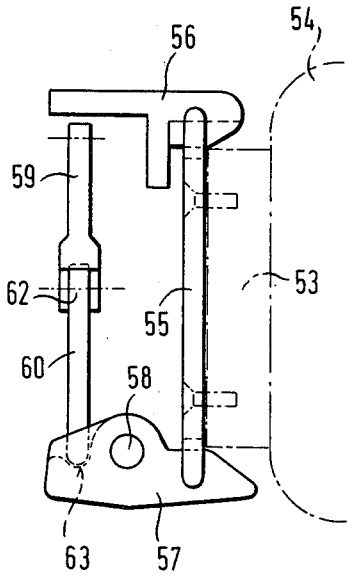
Figure 9:
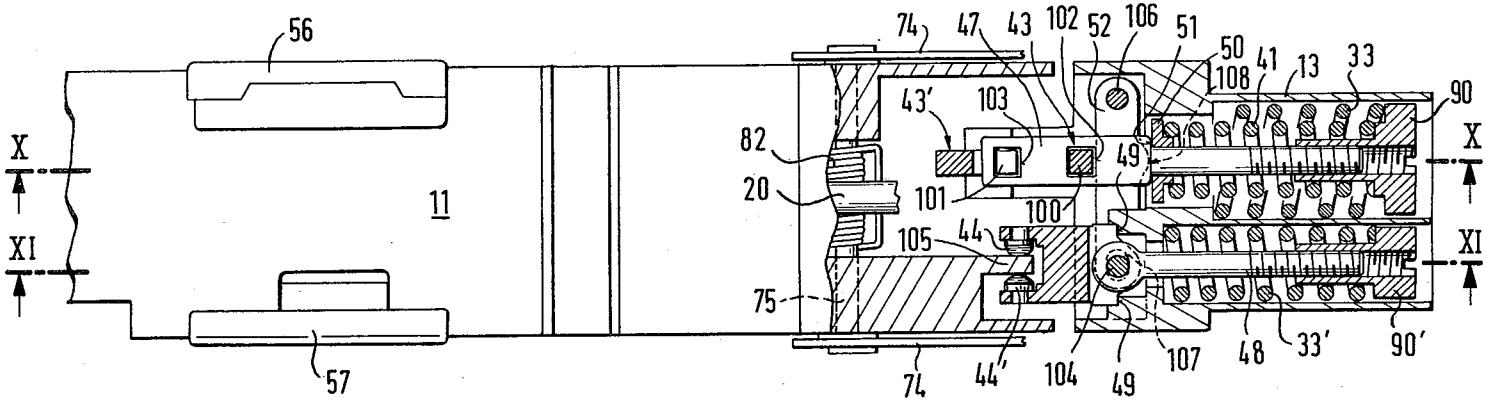
Figure 10:
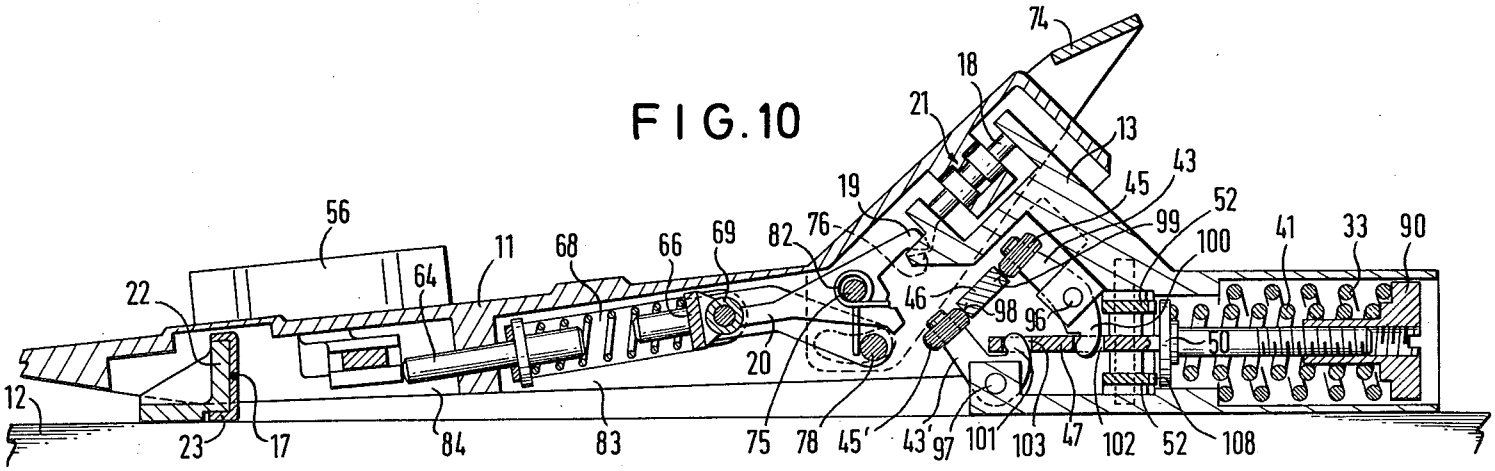
Figure 11:
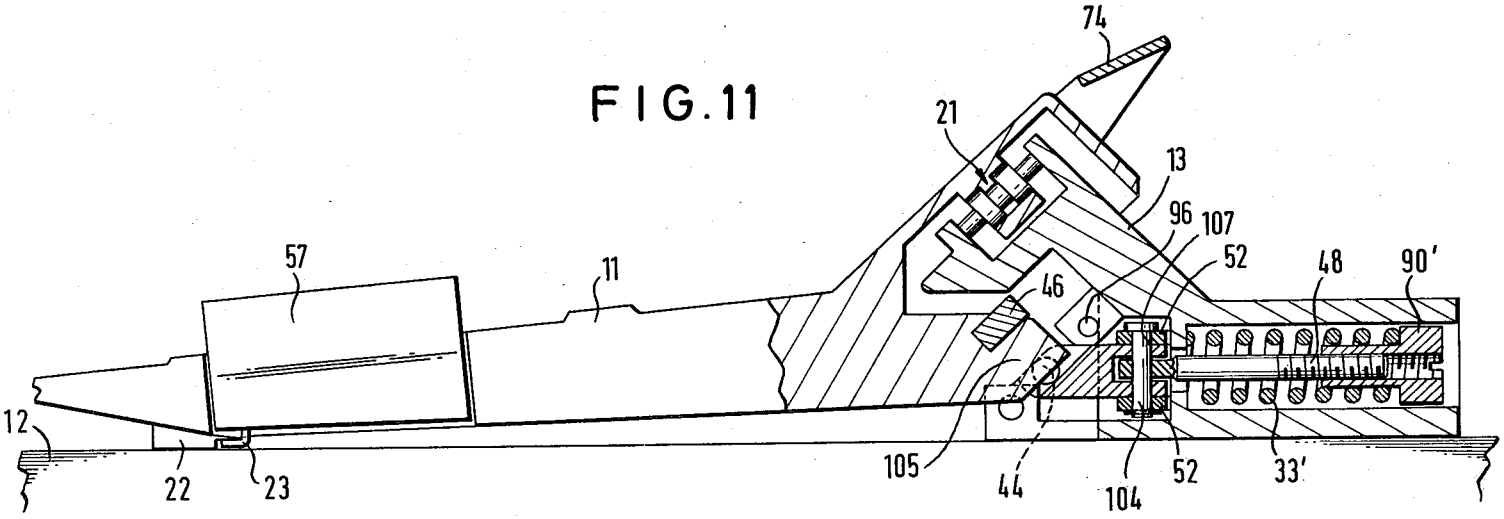
Figure 12:
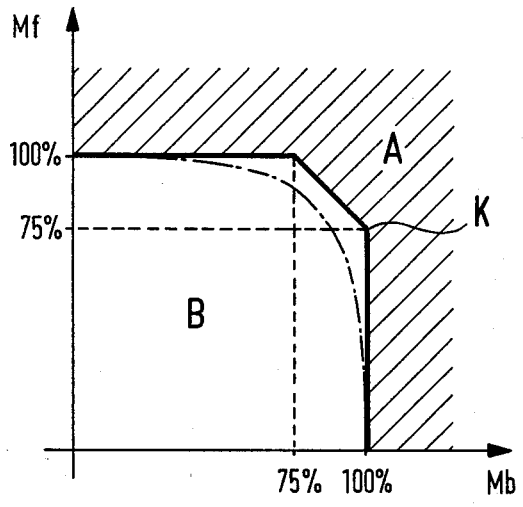

The invention will now be described in more detail by way of example only and with reference to the accompanying drawings in which are shown:

FIG. 1 a partially sectioned side view of a hydraulically operating ski safety binding in accordance with the present invention, FIG. 1*a* a simplified modification of a part of the ski binding of FIG. 1, FIG. 2 a partially sectioned plan view of the subject of FIG. 1, FIG. 3 a section on the line III—III of FIG. 2, FIG. 4 a section on the line IV—IV of FIG. 2, FIG. 5 a plan view of a boot retaining system suitable for use in the ski binding of FIG. 1 and showing a fitting plate for mounting on the sole of a ski boot located within the boot retaining system, FIG. 6 a view of the subject of FIG. 5 on the line VI—VI, FIG. 7 a schematic partially sectioned plan view of the rear part of the binding of FIGS. 1 and 2, FIG. 8 a partially sectioned plan view of a retaining piston arrangement responsible for torsional release of the binding of FIGS. 1 and 2, FIG. 9 a partially sectioned plan view of a mechanically operating embodiment of a ski safety binding in accordance with the present invention, FIG. 10 a section on the line X—X of FIG. 9, FIG. 11 a section on the line XI—XI of FIG. 9 and FIG. 12 a graph showing a preferred characteristic of a ski safety binding in accordance with the present invention and showing the dependence of the torsional release moment on the the bending release moment.

Turning firstly to FIG. 1 there is illustrated a ski safety binding 10 mounted on a ski 12 with a ski boot 54 retained by the binding 10. The ski boot 54 is secured to a sole plate 11 of the binding by a ski boot securing system which is carried by the sole plate 11 and which has two side clamp members 56 and 57 which engage on a fitting plate 55 mounted on the sole of the ski boot. As will be later explained in more detail one of the side clamp members 57 of the ski boot securing system is movable between a closed position in which it clamps the ski boot to the sole plate and an open position in which the ski boot is released from the sole plate. The side clamp member 57 is normally retained in the closed position by a movable plunger 64 which is biased in a forward direction by a coil spring 65 which is reacted against a release mechanism located generally behind the heel of the ski boot. This release mechanism, which will be later described in more detail, basically senses both the bending moment in the plane of the skier's leg about a transverse axis 15 which passes through an endangered section of the skier's leg, i.e. that section which is most commonly subject to breakage, and also the torsional moment on the skier's leg about a vertical axis 24 passing through the transverse axis 25. The release system is adapted to relieve the spring pressure on the plunger 64 and thus to release the ski boot retaining system when the bending and/or torsional moments reach a dangerous level.

The operation of the boot securing system will now be described in more detail having regard also to FIGS. 5 and 6. The plate-like fitting 55 is mounted on the sole 53 of the ski boot 54 in the region of the vertical axis 24 which passes through the endangered section 15 of the skier's leg 16. The plate-like fitting 55 extends at both sides beyond the sides of the sole 53 and engages with the side clamp members 56, 57 of the boot securing system which is attached to the sole plate 11 on which the boot rests. The side clamp 56 is fixedly arranged relative to the sole plate 11 whereas the side clamp 57 can pivot sideways about the longitudinal axis 58 in order to release the sole of the ski boot. A load is applied to the pivotable side clamp 57 in the manner shown in FIG. 2 via a toggle lever system 59, 60 which is movable in a substantially horizontal plane. One link of the toggle lever system is pivotally attached to the right hand side of the sole plate 11 about a vertical pivot 61 while the other link 60, which is connected to the first link via the toggle lever pivot 62, bears against a cup-like recess 63 of the pivotable side clamp member 57 (see also FIG. 4) which is positioned below the longitudinal pivot axle 58 for the side clamp 57.

The toggle lever pivot of the toggle lever system 59, 60 is acted on, via a plunger or push rod 64, by a compression coil spring 65 which is braced at one end against an abutment flange 67 on the plunger 44 and is reacted at its other end against an abutment 66. The spring 65, the flange 67 formed on the push rod 64 and the spring abutment 66 are housed in a U-shaped cage 68. The spring abutment 66 is braced in turn via a roller 69 against a bar-like release lever 20 of the release system arranged behind the heel of the ski boot.

Journals 70 extend sideways in opposite directions from the roller 69 through elongate slots 71 in the sidewalls of the cage 68 and elongate slots 72 in thrust limbs 73 of a hand actuation lever 74. The lever 74 is pivotally mounted about a transverse axis 75 at the end of the sole plate 11 behind the rear edge of the sole 53 of the ski boot. As will be later explained in more detail the hand actuating lever can be used to allow the skier to release or engage the ski boot retaining system at will.

The release lever 20 is likewise pivotally mounted on the sole plate 11 about the transverse axis 75. A measuring sensor 19 of the release lever extends rearwardly behind the pivot axis 75 and has a rounded projection which engages in a cam-like recess 76 in a support block 13 which is fixed to the ski. The end of the rounded projection is braced against the base of the cam-like recess which results in the release lever 20 being held in alignment with the roller 69. As a result the spring 65 is compressed to a sufficient degree that the side journals or transverse pins 70 are moved away from the end of the longitudinal slots 71 and are spaced therefrom by a small distance "a".

The force of the spring is now fully transmitted via the plunger 64 to the toggle lever system 59, 60 so that its links are spread apart and exert a closing force on the movable side clamp 57 via the cup-like recess 63 so that the side clamp 57 adopts the closed position shown in FIGS. 5 and 6. The toggle lever system moves to an over-centre position.

The thrust limbs 73 are pivotally attached to the hand actuation lever 74 via a pivot pin 78 located substantially beneath the pivot axle 75. The pivot pin 78 extends transversely to the longitudinal direction of the ski and is preferably guided in an arcuate cam-track 79 of the sole plate formed about the axis 75. The release lever 20 and the measuring sensor 19 constitute two arms of a component 81 which also has a further arm 80 extending at substantially a right angle to the first two arms. The arm 80 cooperates with the pivot pin 78 in such a way that, on lifting the hand actuating lever 74 in the direction of the arrow f in FIG. 1, the pivot pin 78 engages with the arm 80 and pivots the component 81 in the counter clockwise direction as seen in FIG. 1.

As a result the contact surface 77 of the release lever 20 moves out of engagement with the roller 69 so that the compressed spring 65 can move the roller 69 rearwardly, via the spring abutment 66, until the side journals of FIG. 2 come into abutment with the rear ends of the elongate slots 71. The spring cage 68 is now moved rearwardly until its base 68' abuts on the flange 67. The spring 65 is now inoperative because both its ends are braced against the same component namely the spring cage 68.

The distance "a" between the side journals 70 and the rear ends of the elongate slots 71 and also the distance "b" (FIG. 2) of the flange 67 from the base 68' of the spring cage 68 should be so dimensioned that, after downward pivotal movement of the release lever 20 as a result of lifting of the hand actuating lever 74, the roller 69 contacts the upper surface 81' of the component 81. In this manner, even after releasing the upwardly pivoted hand actuating lever 74, the binding will remain in the released condition. The side clamp 57 can now be pivoted without effort by sideways movement or lifting of the ski boot 54 which causes the roller 59 to slide rearwardly along the upper contact surface 81'.

It can additionally be seen from FIGS. 1 and 2 that the component 81 is biased in the clockwise direction, i.e. in the closing direction of the binding, by a spring 82 shaped like a clothes-peg spring which is braced on one side on the component 81 and, at the other side, on the front edge of the pivot pin 78.

The elongate slot 72 in the thrust limbs 73 must extend sufficiently far rearwardly that the opening movement of the side clamp 57 can take place unhindered, of its own accord, by rearward movement of the roller 69 on the contact surface 81'.

The insertion of the boot in the binding takes place by positioning the ski boot on the sole plate 11 with the fitting plate 55 between the side clamps 56, 57.

If the hand actuating lever 74 is now depressed in the direction of the arrow F of FIG. 1, for example by the use of a ski stick, the thrust limbs 73 are pushed forwardly via the pivot pin 78 until the rear ends of the elongate slots 72 come into abutment with the side pins 70. From now on the roller 69, the spring abutment 66, the cage 68, the spring 65, the plunger 64 and the lever system 59, 60 are moved forwardly as the hand actuation lever 74 is pivoted further downwardly. This movement takes place substantially without effort until the side clamp 57 abuts against the side of the fitting plate. The plunger 64 with the toggle lever system 59, 60 now remains stationary while the transverse pins 70 continue to move forwardly simultaneously compressing the spring 65. Through this movement the side journals 70 move away from the ends of the longitudinal slots 71 and the distances "a" and "b" of FIG. 2 are restored.

As soon as the abutment surface 77 of the release lever 20 is located behind the center point of the roller 69, the force of the spring 82 moves the component 81 in the clockwise direction. As soon as the roller 69 is positioned completely in front of the abutment surface 77 the component 81 has returned to the position shown in FIGS. 1 and 2 in which the measuring sensor 19 engages fully in the cam recess 76 with the release lever 20 being located at the level of the center point of the roller 69. If the hand opening lever 74 is now released then it moves back, under the influence of the same spring 82, into the initial position shown in FIGS. 1 and 2 in which the right hand ends of the elongate slots 72 are clear of the side journals 70. The plunger 64 is now once again completely braced against the release lever 20 via the release spring 65 and the roller 69. The binding is thus once again closed.

The toggle lever mechanism 59, 60 is housed in a chamber 84 of the sole plate 11 whereas the release mechanism is arranged in a further chamber 83. The plunger 64 is of course supported in a transverse wall between the two chambers. The individual components of the boot securing system and the release mechanism are thus protected from the external environment.

The endangered position 15 of the skier's leg 16 is located, as shown in FIG. 1, a distance d equal to 6 to 7 cm beneath the top edge of the shaft of the ski boot between the front and rear edges thereof. As seen in FIGS. 1 and 2 a chamber 85 is provided in the underside of the sole plate 11 substantially below the endangered section 15. A release spring 23 with a substantially vertically extending leaf surface extends from the sidewalls of this hollow chamber to a block 22 mounted on the ski with the leaf spring being fastened to the block at 86. As a result of this construction the sole plate 11 can be tilted by a small amount relative to the support about a transverse axis 17. A small degree of pivotal movement about the central vertical axis 24 to both sides is also possible. It is particularly important that the sole plate 11 can also be displaced forwardly and rearwardly by a small amount relative to the block 22.

The leaf spring 23 represents a simple cardan type support. Spring forces resulting from deformation of the leaf spring 23 are unimportant. It is important for the invention that the block 22 should not be arranged too close to the toe 14 of the ski boot and that it should be arranged as far as possible beneath the endangered section 15.

The sole plate 11 is supported on an inclined guide which consists of two journals 18 mounted in the support block 13 behind the rear of the ski boot. The journals 18 each extend rearwardly upwards in a vertical longitudinal plane at an angle the cotangent of which is approximately the same as the ratio of the distance Z of the endangered section 15 from the sole plate to the horizontal distance Y of the endangered section 15 from the inclined guide. Rollers 26, the cylindrical outer surfaces of which engage in recessed roller tracks 27 of a transverse guide 21 arranged on the sole plate 11 are rotatably and axially displaceably mounted on the fixed guide journals 18. The roller tracks 27 extend transversely to the longitudinal direction of the ski so that, in addition to a small degree of sliding of the end of the sole plate along the guide bars 18, a restricted sideways deflection to either side is also possible. As a result of the inclined guide 18 and the transverse guide 21 the rear end of the sole plate 11 can be displaced in an inclined direction and to either side by a small amount, with the leaf spring 23 ensuring the required resilience at the region where the sole plate is supported on the ski 12.

FIG. 1*a* shows a modification in which the inclined guide is realized by an elongate slot 18' arranged in the support block 13 at a corresponding inclined angle and in which a guide pin 25 connected to the sole plate 11 is able to slide.

In order to hold the sole plate 11 in a defined skiing position restraining pistons 28, 28' which face one another, and which are separated by a hydraulic chamber 31 filled with an incompressible pressure fluid, are provided in cylinders 30 in the bearing block which extend parallel to the inclined guide 18. The end faces 87, 87' of the pistons 28, 28' which face away from one another bear on thrust faces 88, 88' which are provided on the inside of the sole plate 11. Side mounted abutment pins 39 on the piston 28, 28' run in elongate slots 40 of the support block 13 with the elongate slots 40 likewise extending parallel to the inclined guide 18.

In the position which can be seen in FIG. 1 the retaining pistons 28, 28' are located in their extended position in which they firmly contact the thrust surfaces 88, 88'. Further extension of the pistons is prevented by abutment of the abutment pins 39 at the end of the elongate slots 40. Each of the pistons 28, 28' can be moved inwardly towards the hydraulic chamber 31 when acted on by a suitable release force, and as a result of appropriate dimensioning of the elongate slots 40. The manner in which a release force exerts a release pressure on the two pistons 28, 28' of FIG. 1 can be seen most easily from FIG. 1*a*.

The hydraulic chamber 31 is connected with a further cylinder 34 which is also illustrated in FIG. 2. In this cylinder 34 there is located a release piston 32 which is acted on by a spring which presses it against the base of the cylinder 34 and the bias of which can be adjusted by means of an adjusting screw 90. In this position practically no pressure is present in the hydraulic chamber 31. The two pistons 28, 28' are located, in the absence of any force trying to push them inwardly, in their outermost position defined by the abutment pins 39 and the elongate slots 40 and are held in this central position by the pressure fluid and the release piston 32. In corresponding manner retaining pistons 29, 29', arranged in a transversely extending cylinder 30' and separated by a hydraulic chamber 31' filled with an incompressible pressure fluid, hold the sole plate 11 in its central position against the torsional forces via their end faces 92, 92'.

As can be seen from FIGS. 2 and 7, the charging of the hydraulic chamber 31' with an incompressible pressure fluid takes place in the same way as for the "bending moment" release device of FIG. 1*a*. The hydraulic chamber 31' is connected via a line 89' with a cylinder 34' which is arranged in the support block 13. In the cylinder 34' there is located an axially displaceable release piston 32' which, in the illustration of FIG. 7, contacts the base of the cylinder 34' adjacent the line 89'. On the opposite side the release piston 32' is acted on by a release spring 33' the bias of which can be reduced or increased by an adjusting screw 90'. By suitable adjustment of the adjusting screw 90' it is possible to set that release pressure in the hydraulic chamber 31' at which one of the two retaining pistons 29, 29' can slide into the hydraulic chamber 31' with simultaneous deflection of the release piston 32' and compression of the release spring 33'.

The outward movement of the pistons of the torsional release device of FIGS. 2 and 7 is restricted, in just the same manner as the corresponding movement of the retaining pistons 28, 28' for the "bending moment" release, by the abutment pins 39. The two figures show the most extreme extended positions of the retaining pistons 29, 29'. In the absence of any force pressing them inwardly the retaining pistons 29, 29' will remain in this position by virtue of the release spring 33, the release piston 32' and the pressure fluid.

FIGS. 1, 1*a* and 7 also respectively show a non-return valve 35, 35' connected to the connection line 89 and the hydraulic chambers 31, 31'. Each non-return valve 35, 35' leads via a connection line 91, to a cylinder-like storage chamber 36. A piston 37 acted on by a spring 38 is axially displaceably arranged within the storage chamber 36 and at a significant distance from the base of the storage chamber 36. As seen in FIG. 1 both non-return valves 35, 35' are connected via a common connection line 91 to a single storage chamber 36.

The piston acted on by the spring 38 maintains, in the storage chamber 36, a small pressure which is dependent on the force of this spring. The storage chamber 36 contains a pressure fluid, in particular a reserve of oil, for both release systems. If the pressure sinks in one of the hydraulic chambers 31, 31' to zero or beneath a predetermined low basic pressure the associated non-return valve 35, 35' opens and pressure fluid is added to the relevant hydraulic chamber 31, 31' until all the leakage losses have been compensated and the minimal pressure which is determined by the spring 38 and which is necessary for the functioning of the system has once again been achieved. This minimal pressure should be as low as possible in order to reduce leakage losses during non-use of the binding to a minimum.

During a release procedure the pressure in the hydraulic chambers 31, 31' increases whereby the associated non-return valve 35, 35' is loaded in the closed direction. An increase pressure in the hydraulic chambers 31, 31' cannot thus be communicated to the compensation chamber 36.

The binding in accordance with the invention is particularly suitable for the realization of a release characteristic which closely approximates the hypothetical conditions prevailing as the breaking point of a leg is approached.

FIG. 12 shows an ideal release characteristic corresponding to the leg breakage hypothesis using a chain dotted line. FIG. 12 represents the dependence of the torsional moment Mt (about a vertical axis) in relation to the bending moment Mb (about the transverse axis). For moments within the inner region B of the chain dotted characteristic the ski boot is intended to be retained by the binding whereas, for moment pairs on the chain dotted line release of the ski boot is intended to take place. In the outer region A of the curve the binding has in any event released.

A modification of the ski safety binding which allows the ideal characteristic to be approximated by the polygonal release curve illustrated in full lines in FIG. 12 will now be described with reference to FIGS. 2 and 8.

The object is to reduce the size of the bending moment Mb at which release takes place above a specific torsional moment and to reduce the torsional moment Mt at which release takes place above a specific bending moment.

For this purpose an auxiliary piston 42 is provided in the arrangement of FIGS. 2 and 8 and is displaceably located within an axial cylindrical bore of the release piston 32. An abutment shoulder 94 limits the movement of the auxiliary piston 42 in the direction of the release movement of the piston 32. The auxiliary piston 42 is acted on by an auxiliary spring 41, which, in accordance with the present teaching, is braced against the same adjustment screw 90 as the release spring 33.

The end face of the auxiliary piston 42 remote from the auxiliary spring 41 is subjected to pressure via a hydraulic line 95 which is connected with the hydraulic chamber 31' for torsional release.

In the event that release takes place due to a bending moment about the transverse axis through the endangered section 15, and no pressure is present in the hydraulic chamber 31', then this release takes place by the release piston 32 being pushed backwardly against the force of the spring 33 in the customary manner. The abutment shoulder 94 moves away from the auxiliary piston 42 which remains in the position shown in FIGS. 2 and 8 under the influence of the auxiliary spring 41.

If, however, as a result of a torsional load on the skier's leg, a sufficiently high pressure is achieved in the hydraulic chamber 31 to compress the auxiliary spring 41, this pressure can for example amount to 75% of the release pressure, then the auxiliary piston 42 pushes to a greater or lesser degree on the release piston 32 via the abutment shoulder 94 and so assists the compression of the release spring 33. The bending moment release thus takes place with a reduced pressure in hydraulic chamber 31 which depends on the pressure in the hydraulic chamber 31'.

This behaviour is illustrated in the full line illustration of FIG. 12. As seen in this drawing 100% of the bending moment Mb is necessary to produce release until 75% of the torsional release moment is reached. Above this point k of the curve, i.e. between 75 and 100% of the torsional moment Mt necessary to produce release, the bending moment Mb necessary to produce release progressively reduces until, at 100% of the torsional release moment Mt it amounts to only 75% of the 100% bending moment that is necessary if no torsional moment is present. For bending moments under 75% of the release value, 100% of the torsional moment Mt is then necessary for the torsional release. It is surprising that no additional measures for the reduction of the torsional release moment on the presence of a bending moment which exceeds a specified value (75%), with the exception of the branch of the line 95 (FIG. 8), are necessary within the torsional release mechanism of FIG. 7. If the bending moment Mb reaches 75% of the release value without the existence of a simultaneous torsional moment then, as seen in FIG. 12, the torsional moment necessary for release will linearly reduce to 75% as the bending moment Mb increases from 75% to 100%. This occurs because, in accordance with the invention, both the torsional and bending moments jointly produce a single release signal. It is thus immaterial whether a specific torsional moment (for example 75% of the release value) reduces the bending moment for release or vice versa.

In accordance with the invention the auxiliary piston is however consciously incorporated in the release piston 32 of the binding release mechanism. In this way the torsional release mechanism of FIG. 7 can be provided with the simplest possible construction. In particular the frictional sliding forces occurring during movement of the retaining pistons 29, 29' and the release piston 32' are reduced to a minimum. It can thus be ensured, after movement of these pistons, that they rapidly and completely return to their normal positions as soon as the torsional moment abates. This is extremely important for the torsional release behaviour of a ski safety binding. As can be seen from FIG. 12 suitable selection of the position of the discontinuity k results in a good approximation of the release characteristic to the ideal chain dotted curve representing the leg breakage hypothesis. The arrangement of the discontinuity k at 75% of the release value is preferred, but can however take place at another percentage value, for example 50%.

The manner of operation of the ski safety binding of FIGS. 1 to 8 is as follows:

Hand actuation by means of the lever 74 has already been described above as has the closing of the binding by depression of the hand actuation lever 74 in the direction of the arrow F.

If, as a result of the exertion of a torque about the transverse axis through the endangered section 15, one of the pistons 28, 28' moves into the hydraulic chamber 31 while compressing the release spring 33 as a result of the release setting being exceeded, the measuring sensor 19 is lifted out of the cam recess 76 and the roller 69 is correspondingly released whereupon the binding is open. As the cam recess 76 of FIG. 2 is also effective in a sideways direction a release also takes place when one of the pistons 29, 29' working in the lateral direction is displaced against the pressure in the hydraulic chamber 31' with simultaneous compression of the release spring 33' as a result of an excessive torsional moment on the skier's leg.

The superposition of a bending moment about the transverse axis 15 and a torsional moment about the vertical axis 24 results in the leg breakage hypothesis, in accordance with which mutual interaction of the bending and torsional moments occurs, being taken into account as a result of the special construction of FIGS. 2 and 8 as is illustrated in FIG. 12.

The release piston 32 determines the release setting for a bending moment Mb which is dangerous for the skier's leg and which is exerted about a transverse axis passing through the endangered section 15. If, at the same time, a torsional moment is present the pressure in the hydraulic chamber 31', which is proportional to the size of the torsional moment, operates, in accordance with FIGS. 2 and 8, against the small auxiliary piston 42. This piston will however not exert any force on the large piston 32 until it overcomes the force of the spring 41. Only when the pressure in the torsional hydraulic chamber 31' and supplied by the line 95 is sufficiently large (preferably 75% of the maximum permissible torsional moment equal to the discontinuity k in FIG. 12) does the auxiliary piston 42 overcome the force of the spring 41 and press additionally with its excess force on the piston 32. If now, at the same time, a bending moment operates about the transverse axis extending through the endangered section 15, the release spring 33 is compressed at a lower bending moment and the binding is opened i.e. released. The bias of the auxiliary spring 41 thus determines the position of the discontinuity k from which point on the desired reduction of the bending release moment takes place. It is of particular advantage that the discontinuity always remains at the same percentage value independently of the selected release value, because the springs 41, 33 are acted on by the same adjustment screw 90 and are thus also necessarily always jointly adjusted. In corresponding fashion the torsional release moment for bending moments above 75% of the maximum value are reduced linearly to 75% of the initial value.

As a result of the arrangement of the inclined guide 18 in accordance with the invention, and the support of the sole plate at the point 22 beneath the endangered section 15, the release of the binding always takes place at a bending moment which acts about the transverse axis through the endangered section 15 and which is set by adjustment of the screw 90 unless, as a result of the superimposition of a torsional moment, this bending release moment is consciously reduced in order to take account of the leg breakage hypothesis.

In the embodiment of FIGS. 9 to 11 the ski boot securing system, the retention of the sole plate 11 at 22, 23 and also the inclined guide 18 and the transverse guide 21 are constructed in just the same way as for the previous embodiment. The same reference numerals are used to designate parts which have counterparts in FIGS. 1 to 8. In order to simplify the representation the release mechanism is only schematically illustrated unless it is differently constructed to the arrangement of FIGS. 1 to 8.

The bias of the rear part of the sole plate towards the normal position takes place in the embodiment of FIGS. 9 to 11 by mechanical means. With regard to the bending movement release about the transverse axis passing through the endangered section 15 these means comprise two pivoted levers 43, 43', shown in FIGS. 9 and 10, which are pivotally attached about transverse axes 96, 97 to the ski mounted support block 13. The pivoted levers 43, 43' engage via rollers 44, 45' on opposite sides of a rail 46 extending transversely to the longitudinal direction of the ski. Both the rail 46 and also the plane of the rollers 45, 45' extend parallel to the inclined guide 18. The pivoted levers 43, 43' exert a retaining force on the opposite sides 98, 99 of the rail 46 as will be described in detail in the following:

The pivoted levers 43, 43' have lever arms 100, 101 which project beyond the transverse axes 96, 97 and which, as shown in FIG. 10 are so angled that their ends lie at substantially the same level above the surface of the ski 12 and exactly behind each other. The arms 100, 101 engage in cut-outs 102, 103 of a pull rod 47 which extends in the longitudinal direction of the ski and is acted on by bending moment release springs 33 and 41. The spring 33 is braced at its front end on the support block 13 and at its rear end on an adjusting screw 19 which is threaded to the rear end of the pull rod 47 to allow the spring bias to be adjusted. One of the abutments for the second auxiliary release spring 41 is also located on the adjusting screw 19.

As a result of this construction the two pivoted levers 43, 43' are pivoted towards one another from one and the same spring pair 33, 41 and are brought into contact with opposite surfaces 98, 99 of the rail 46. As a result the sole plate 11 is biased along the inclined guide 18 to a normal position.

In FIGS. 9 and 11 a further pull rod 48 is arranged alongside and spaced sideways from the pull rod 47 and the bias spring 33 and 41 which act thereon. The pull rod 48 is biased rearwardly by a torsional release spring 43'. An adjustment screw 90' once again allows the bias of the torsional release spring 33' to be adjusted.

Pivoted levers 44, 44' which are pivotable about a vertical axis and are united to form a single component are pivoted at the front end of the pull rod 48. The pivoted levers 44, 44' contact the support block 13 via pivot edges 49 provided on both sides of the hinge 104. As a result of the operation of the release spring 33' the component 44, 44' is pulled against both pivot edges 49.

The pivoted levers 44, 44' engage from opposite sides on an axial continuation 104 of the sole plate 11. As the pivoted levers 44, 44' are biased by the spring 33' into the central position shown in FIG. 9 the sole plate 11 is held at its rear end in a central position by the pivoted levers 44, 44'.

As seen in FIG. 11 the axial continuation 105 is scarfed off parallel to the inclined guide 18 at its end which engages the pivoted levers 44, 44'. In this manner it is ensured that the pivoted levers 44, 44' remain in engagement with the continuation 105 of the sole plate 11 during movement of the sole plate along the inclined guide 18.

The rail 46, as already mentioned above, extends transversely to the longitudinal direction of the ski so that even during torsional movement of the sole plate 11 the engagement between the rollers 45, 45' and the rail 46 is maintained.

The moment required for bending release is influenced by the prevailing torsional moment, in accordance with the leg breakage hypothesis of FIG. 12, by means of a pair of links 52 which extend as shown in FIGS. 9 and 10 between the pull rods 47, 48. The pair of links 52 are pivotally attached at one end to the support block 13 about a vertical axis 106. The other end of each pivoted link 52 is connected to the hinge 104 between the pull rod 48 and the components 44, 44' via an elongate slot 107 extending in the transverse direction.

A spring plate 50 is axially displaceably positioned on the pull rod 47 as shown in FIG. 9. The spring plate 50 is pressed by the second release spring 41 against an abutment step 51. The spring 41 is braced in the same manner as the release spring 33 against the adjustment screw 90 so that the bias settings of both springs are once again jointly adjusted.

Rearwardly projecting noses 108 on the pivoted plates 52 can engage with the front surface of the spring plate 50 when the spring plate 50 moves a small distance in the direction of the plates 52.

The functioning of the embodiment of FIGS. 9 to 11 is analogous to that of the previous embodiment. In the event of a movement of the sole plate 11 along the inclined guide 18 one of the two pivoted levers 43, 43' will be pivoted outwardly with simultaneous compression of the release spring 33 as soon as the bias of the release spring 33 is exceeded. The other of the two pivoted levers 43, 43' will pivot at the same time in the opposite direction and thus lifts away from the associated contact surface 98, 99 of the transverse rail 46. The outward pivotal movement of the relevant pivoted lever 43, 43' exerts a resetting moment towards the normal position on the sole plate 11. For larger pivotal movements the measuring sensor 19 once again comes out of the cam recess 76 and the binding releases in the manner described above with reference to FIGS. 1 to 8.

In the event of a torsional moment acting on the sole plate 11 the component 44, 44' is released in the corresponding direction as soon as the bias of the release spring 33' is overcome.

As a result the component 44, 44' pivots about one of the pivot edges 49. The rollers 45, 45' roll during this movement along the rail 46. The measuring sensor 19 once again comes free of the cam recess 76 on the occurrence of a correspondingly large torsional pivotal movement and releases the binding.

The links 52 make it possible in accordance with FIG. 12 for the value of the torsional release setting to reduce with increasing bending movement and vice versa. If namely, as a result of a minimal release movement about the transverse axis passing through the endangered position 15, the pull rod 47 is moved by an infinitesimal distance in the forward direction the spring plate 50 will come into contact with the noses 108 of the links 52. The spring plate 50 now lifts off the abutment step 51 and the force of the second release spring 41 is transmitted via the links 52 to the hinge 104 and thus to the pull rod 48.

The full release force of the two springs 33, 41 now operates in the bending release part while the torsional release moment reduces in accordance with the force transmitted from the spring 41 via the spring plate 50 to the links 52.

If, in reverse, a torsional release takes place then the noses 108 separate from the spring plate 50 so that the spring plate 50 is braced on the abutment step 51 of the pull rod 47 and the effect of the spring 41 is neutralized. Only the release spring 33 now operates on the bending release mechanism. Providing the ratios of the forces of the springs 41 and 33 amount to 25:75 then, during a torsional release the bending release moment will be reduced to 75% of the maximum value as shown in FIG. 12. The lever ratio of the links 52 is to be so selected that, in the case of a bending release, the force of the torsional spring 33' will be counteracted by a sufficient amount that the torsional release force will be reduced to 75% of the maximum value. The characteristic shown in FIG. 12 will then be accurately achieved.

We claim:

1. A ski safety binding for protecting a skier during skiing against both a dangerous bending moment acting on a leg of the skier at an endangered section of the skier's leg and a dangerous torsional moment acting about the leg, said ski safety binding comprising: a sole plate; a ski boot securing system carried by said sole plate for releasably securing a ski boot to said sole plate; mounting means for mounting the sole plate on a ski having an upper surface and a longitudinal direction, for limited displacement in said longitudinal direction, and for limited pivotal movement about a transverse axis and about a vertical axis extending substantially along the skier's leg; guide means disposed between said sole plate and said ski and displaced in said longitudinal direction from said vertical axis, said guide means including an inclined guide extending at an inclined angle to said upper surface of the ski in a vertical plane including said longitudinal direction and a transverse guide extending in a direction transverse to said inclined guide; first retaining means for retaining the sole plate in a specified position along said inclined guide; second retaining means for retaining the sole plate in a specified position along said transverse guide; first resilient means permitting resilient deflection of said first retaining means on the occurrence of excessive forces thereon due to said bending moment to allow movement of said sole plate along said inclined guide; second resilient means permitting resilient deflection of said second retaining means on the occurrence of excessive forces thereon due to said torsional moments to allow limited movement of said sole plate along said transverse guide, and sensor means responsive to said limited movement along said inclined guide and to said limited movement along said transverse guide to release said boot securing system.

2. A ski safety binding in accordance with claim 1, wherein said mounting means is located beneath the endangered section of the skier's leg.

3. A ski safety binding in accordance with claim 2, wherein said inclined guide is inclined at an angle to said longitudinal direction with the co-tangent of said angle being substantially equal to the ratio of the distance of the endangered section from the sole plate to the horizontal distance of the endangered section from said inclined guide.

4. A ski safety binding in accordance with claim 1, wherein said transverse guide is arranged in the vicinity of the inclined guide.

5. A ski safety binding in accordance with claim 1, and further comprising a leaf spring extending transversely to said longitudinal direction, and leaf spring having first and second major surfaces disposed substantially perpendicular to said upper surface between the sole plate and a support mounted on the ski.

6. A ski safety binding in accordance with claim 1, wherein said inclined guide comprises at least one elongate slot, there being a guide pin slidably received in said elongate slot.

7. A ski safety binding in accordance with claim 1, wherein said inclined guide comprises first and second guide bars mounted on said ski, and wherein slide members mounted on the sole plate are arranged on said guide bars for sliding movement therealong.

8. A ski safety binding in accordance with claim 7, wherein said slide members are rollers, wherein said transverse guide is formed on said sole plate and includes roller tracks which extend transversely to said longitudinal direction, and wherein said rollers are arranged in said roller tracks.

9. A ski safety binding in accordance with claim 1, wherein said guide means includes a support block mounted on said ski, which said sole plate having a recessed portion engaging over said support block, and wherein said first and second retaining means are disposed between said recessed portion of the sole plate and said support block.

10. A ski safety binding in accordance with claim 9, wherein first and second hydraulic chambers are provided in said support block, wherein said first and second retaining means comprise retaining pistons arranged for movement in said first and second hydraulic chambers, and wherein means are provided for charging said chambers with a hydraulic fluid and for allowing hydraulic fluid to escape from the respective chamber when either said dangerous bending moment or said dangerous torsional moment is reached.

11. A ski safety binding in accordance with claim 10, wherein said first hydraulic chamber comprises a first cylindrical passage extending parallel to said inclined guide, wherein said first retaining means comprises first and second retaining pistons having respective end faces remote from one another which bear on said sole plate, respective abutments for limiting their respective movements out of said first cylindrical passage, and wherein said means for allowing hydraulic fluid to escape comprises a first spring loaded release piston disposed in a further hydraulic chamber connected to said first hydraulic chamber by a passage.

12. A ski safety binding in accordance with claim 11, wherein said first hydraulic chamber is connected to a hydraulic fluid storage chamber via a non-return valve.

13. A ski safety binding in accordance with claim 12, wherein said second hydraulic chamber comprises a second cylindrical passage extending parallel to said transverse guide, wherein said second retaining means comprises third and fourth retaining pistons having respective end faces remote from one another which bear on said sole plate, respective abutments for limiting their respective movements out of said second cylindrical passage, and wherein said means for allowing hydraulic fluid to escape comprises a second spring loaded release piston disposed in another hydraulic chamber connected to said second hydraulic chamber by a second passage.

14. A ski safety binding in accordance with claim 13, wherein said second hydraulic chamber is connected to said hydraulic fluid storage chamber via a further non-return valve.

15. A ski safety binding in accordance with claim 13, wherein means are provided for relieving the spring load on one of said first and second spring loaded pistons in response to an increase of pressure in the other one of said first and second hydraulic chambers whereby said dangerous bending moment required to produce release of said boot securing system is reduced as said torsional moment increases above a predetermined value and vice versa.

16. A ski safety binding in accordance with claim 15, wherein said means for relieving the spring load comprises an auxiliary spring loaded piston having its own bias spring, with said auxiliary spring loaded piston acting on said first spring loaded piston in dependence on the pressure in said second hydraulic chamber.

17. A ski safety binding in accordance with claim 9, wherein said first resilient means comprises a first spring, and wherein said first retaining means comprises first and second levers pivotally arranged on said support block and bearing on said sole plate under the bias of said first spring.

18. A ski safety binding in accordance with claim 17, wherein said sole plate includes a transverse rail having opposite side faces passing across said recessed portion, wherein first and second levers bear on said opposite sides of said rail, and wherein said first and second levers are connected to said first spring via a common pull rod.

19. A ski safety binding in accordance with claim 18, wherein said first and second levers bear on said rail via respective rollers.

20. A ski safety binding in accordance with claim 18, wherein said second resilient means comprises a second spring, and wherein said second retaining means comprises third and fourth levers bearing on said sole plate under the bias of said second spring.

21. A ski safety binding in accordance with claim 20, and wherein said third and fourth levers are formed on a common component and are connected to said second spring via a common pull rod.

22. A ski safety binding in accordance with claim 21, and wherein said third and fourth levers are arranged to pivot about respective edge pivots disposed between said component and said support block on opposite sides of said pull rod.

23. A ski safety binding in accordance with claim 21, and wherein means are provided for relieving the spring load of one of said first and second springs on the associated one of said first and second retaining means in response to an increase of the spring load on the other one of said first and second retaining means, whereby said dangerous bending moment required to produce a release of said boot securing system is reduced as said torsional moment increases above a predetermined value, and vice versa.

24. A ski safety binding in accordance with claim 23, wherein said means for relieving the spring load of one of said first and second springs comprises a further spring surrounding said first pull rod, an abutment on said first pull rod, a spring plate slidably disposed on said first pull rod and normally biased by said further spring against said abutment, and lever means positioned in the vicinity of said abutment for communicating the load of said further spring to said second pull rod on displacement of said first pull rod and vice versa.

* * * * *